US005647524A

United States Patent [19]

Rautenberg

[11] Patent Number: 5,647,524

[45] Date of Patent: Jul. 15, 1997

[54] TEARING-OFF ROLLER PAIR

[75] Inventor: Horst Rautenberg, Lienen, Germany

[73] Assignee: Windmöller & Hölscher, Lengerich, Germany

[21] Appl. No.: 384,896

[22] Filed: Feb. 7, 1995

[30] Foreign Application Priority Data

Feb. 14, 1994 [DE] Germany ..... 44 04 662.6

[51] Int. Cl.[6] ..... B65H 35/10; B65B 41/10

[52] U.S. Cl. ..... 225/106; 225/100; 493/425; 493/432

[58] Field of Search ..... 225/100, 103, 225/93, 94, 96, 106; 83/116, 117, 128, 139, 347, 348, 659; 493/424–430, 432, 433

[56] References Cited

U.S. PATENT DOCUMENTS

| | | | |
|---|---|---|---|
| 1,784,757 | 12/1930 | Scott | 493/427 X |
| 1,978,136 | 10/1934 | Kavle | 83/117 |
| 2,088,118 | 7/1937 | Schillo | 83/117 |
| 2,450,312 | 9/1948 | Tollison | 83/347 X |
| 4,095,780 | 6/1978 | Gaspar et al. | 493/430 |
| 5,111,725 | 5/1992 | Simpson et al. | 83/117 |
| 5,312,032 | 5/1994 | Rautenberg et al. | 225/100 |

FOREIGN PATENT DOCUMENTS

| | | | |
|---|---|---|---|
| 1216676 | 5/1966 | Germany . | |
| 2610628 | 9/1977 | Germany | 83/139 |

*Primary Examiner*—Rinaldi I. Rada
*Assistant Examiner*—Clark F. Dexter
*Attorney, Agent, or Firm*—Keck, Mahin & Cate

[57] ABSTRACT

A tearing-off roller pair, for tearing off sections or strips divided by perforation cuts from a material web, consists of a first roller with a substantially smooth steel shell and, applied against it, a second roller with a resilient body set into it for increasing the contact pressure, which resilient body projects above its peripheral surface in its unstressed state. To allow a greater retaining force to be exerted on the sections to be torn off, several of the resilient bodies are set in a recess along a cylindrical surface of the second roller.

2 Claims, 5 Drawing Sheets

TEARING-OFF ROLLER PAIR

FIELD OF THE INVENTION

The invention concerns a tearing-off roller pair for tearing off from a material web sections or strips divided by perforation cuts, consisting of a first roller with a substantially smooth steel shell and, applied to it, a second roller with a resilient and/or sprung body set into it for increasing the contact pressure, which body projects beyond its peripheral surface in its unstressed state.

PRIOR ART

For producing stacks of strips and in many manufacturing processes, there are required sections or strips torn off along perforation cuts from a material web made of paper or a synthetic material for instance. For example, sack manufacturing machines are usually provided with a supplementary bottom cover station, wherein sections divided in a material web by perforation cuts are tom off and fed to the still opened bottoms as supplementary bottom covers.

Tearing off roller pairs are known, whereof at least one roller is provided with a roughened circumferential zone extending over the length of the roller for increasing the grip in the angular zone wherein the tearing-off roller pair must absorb the tearing-off tension. Admittedly, the gripping force of the tearing-off roller pair is increased by this roughened circumferential zone. However the retaining force is not particularly high, since the force with which the rollers of the tearing-off roller pair are pressed against each other is distributed over the whole line of contact, so that the specific area of pressure exerted on the sections to be tom off is relatively small.

From DE-B-12 16 676, a roller pair of the kind indicated at the outset is known which, admittedly, serves not for the tearing off of sections from a material web but for pulling forward the start of a material web after a leading section has been separated from the latter by a roller of the roller pair designed as a cutter roller. To exert a higher contact pressure on the new start of the web formed by the severing cut for the forward pull, a pressure bar made of a plastic material is arranged directly behind the cutter in a gap-shaped groove, which bar is displaceable in a radial direction and supported on compression springs and cooperates with the counter roller. This pressure bar too is capable of exerting only a relatively low contact pressure on the start of the web to be pulled forward, since the pressure is distributed over a large area over the length of the pressure bar.

OBJECT OF THE INVENTION

It is the object of the invention to create a tearing-off roller pair of the kind indicated at the outset which is capable of exerting on the sections to be tom off a greater retaining force than hitherto.

SUMMARY OF THE INVENTION

In accordance with the invention, this problem is solved by a tearing-off roller pair for tearing off sections or strips divided by perforation cuts from a material web, consisting of: a first roller with a substantially smooth steel shell and, applied against said first roller, a second roller with several interspaced resilient bodies set into recesses in a cylindrical surface of the second roller, for increasing the contact pressure, which bodies project beyond the peripheral surface of said second roller in their unstressed state.

The tearing-off roller pair in accordance with the invention is capable of exerting a greater retaining force on the sections to be torn off because, instead of a continuous pressure bar, there are several resilient bodies with a small surface area so that, because of their smaller zone of action, they are capable of exerting a much higher specific area pressure on the sections to be torn off.

Expediently, in a gap or a groove of the second roller there is a bar that can be pushed in against a spring force and which carries the resilient bodies at its front face. Expediently, the bar is provided at its front face with a recess that is parallel to a cylindrical surface of the second roller into which the resilient bodies are set-in with an interspacing from each other.

Advantageously, provision is made for the gap or groove accommodating the bar to be arranged in a plane parallel to the diametral plane of the second roller, and to lie behind this diametral plane in the direction of rotation when the diametral plane intersects the line of contact with the first roller. This embodiment ensures that the resilient bodies grip the section to be torn off and press it against the counter roller ahead of the line of contact between the two rollers.

In a further preferred mode of embodiment, the resilient bodies may have substantially planar surfaces and be set obliquely into the bar holding them, in such a way that their front edges at the point of contact with the first roller form an acute angle with the tangent drawn through the point of contact. Thus in this embodiment, the resilient bodies have their leading angular edges engaging with an increased area of pressure on the sections to be torn off, so that in practice the resilient bodies slightly cut into the sections to be torn off, or claw into them.

A further advantage of this design lies in the fact that the resilient bodies also ensure at the same time a good guidance on the counter roller for the sections to be torn off, which is important in particular when the counter roller is designed as a folding gripper cylinder as will still be described in greater detail below. Good guidance for the sections to be torn off by the resilient bodies is obtained in that the resilient bodies roll off, as it were, from the sections pressed by them against the counter roller.

Expediently, the front face of the bar is curved to correspond to the peripheral surface of the second roller interrupted by it.

To introduce the tearing-off tension produced by the resilient bodies, over the shortest distance, directly into the parts to be torn off the resilient bodies are expediently arranged in the respective zones of the second roller that are traversed by the lands of the perforation cuts.

In a further development of the invention, the first roller may be designed as a gripper cylinder, and the second roller as a folding blade-cylinder. Because of their increased clamping force and their good guidance action, the resilient bodies ensure that the sections clamped with their front ends in the folding grippers of the folding gripper cylinder do not slide because of the tearing off tension, and are not pulled out of the folding grippers of the folding gripper cylinder.

Expediently, the resilient bodies are arranged closely, for example at an angular interspacing of 3–15 degrees, behind the folding blade of the second roller.

The resilient bodies may consist of a relatively hard material, for example, of hard rubber or a hard resilient synthetic material.

BRIEF DESCRIPTION OF THE DRAWINGS

An embodiment of the invention will be explained in greater detail below with reference to the drawings, in which.

DETAILED DESCRIPTION OF THE PREFERRED EMBODIMENT

Figure 1:
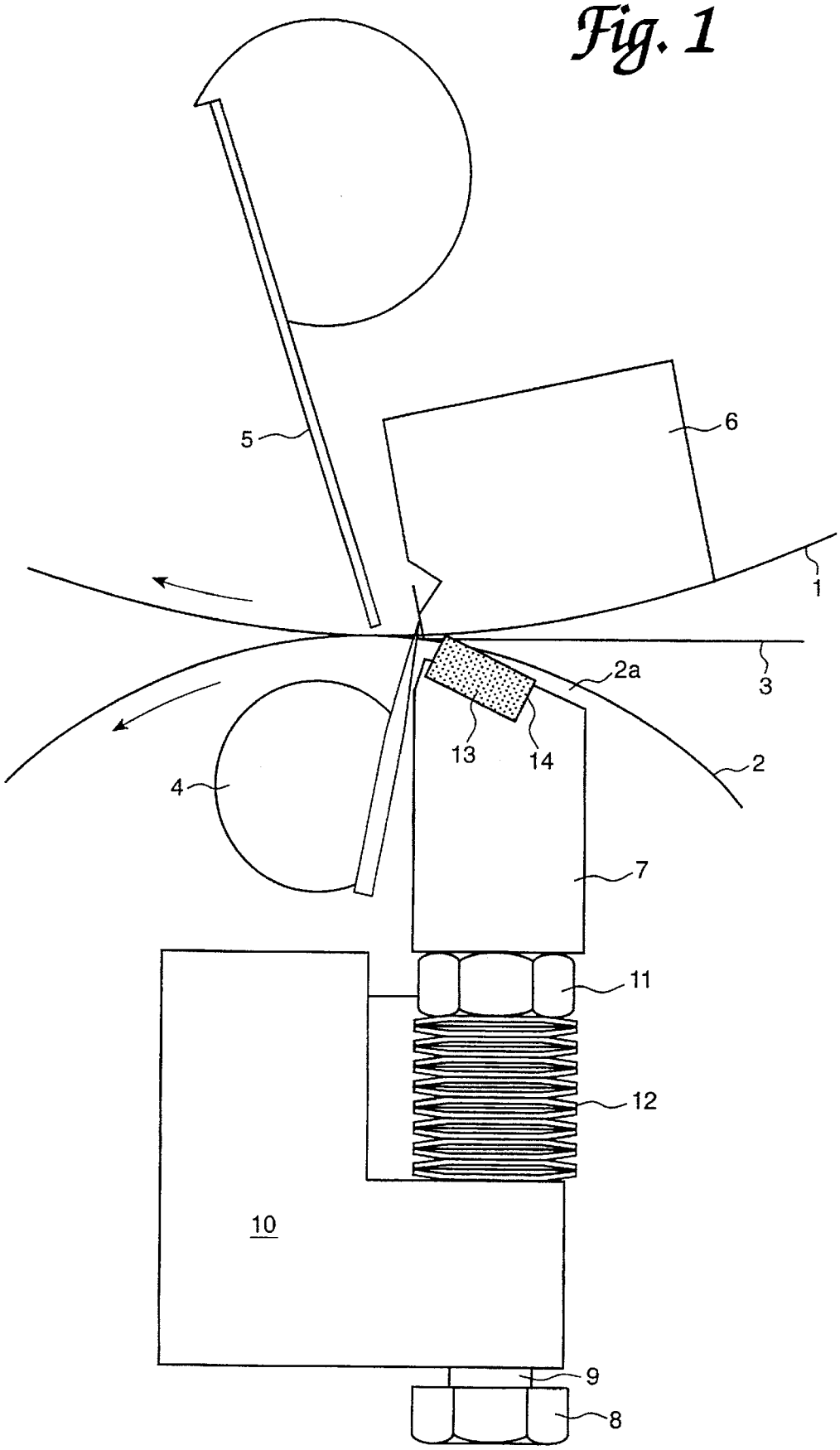
FIG. 1 shows cut-off portion of the tearing-off roller pair in the zone of the line of contact, as a schematic side view at the time when the resilient bodies are just beginning to act on the section to be torn off.

The tearing-off roller pair consists of a first roller 1, which is formed by a conventional folding gripper cylinder, and a second roller 2 which is provided in the usual way with a radially projecting folding blade 4 introducing into the opened folding gripper the front end of the section 3 to be torn off. The folding gripper of the first cylinder 1 consists in the usual way of a gripper lever 5 which is controlled in the usual way, and a counter holding bar 6 which is set into the folding gripper cylinder 1 and delimits a part of its cylindrical surface.

A pressure bar 7 is carried for radial displacement in a conventional gap or groove 2*a* of the second roller 2. The pressure bar 7 has, in the zone of its ends, screw-bolts 9 screwed into them and provided with heads 8; their unthreaded shaft zones are carried in bores of holding components 10 which are rigidly connected to the roller 2. A cup-spring assembly 12 is inserted between (a) a lock nut 11 screwed onto the bolt 9 and (b) the outer edge of the through bore of the holding component 10. The radial position of the pressure bar 7 in the gap or groove 2*a* of the roller 2 can be set by an appropriate adjustment of the lock nut 11 which defines the screwing-in depth of the screw-bolt 9 in the pressure bar.

As shown in FIG. 1, the median plane of the pressure bar 7 extends in a plane parallel to the diametral plane of the second roller, but lies behind the diametral plane when the latter intersects the line of contact with the first roller.

At its front face 7*a*, the pressure bar 7 has a recess 13 wherein are mounted with a mutual interspacing resilient bodies 14 which may consist of a hard resilient synthetic material, for example polyurethane rubber. The front face 7*a* of the pressure bar 7 is provided with a cylindrical shell-shaped curvature which corresponds to the curvature of the peripheral surface interrupted by it.

FIG. 1 shows the position where the folding blade 4 just pushes the front end of the section 3 into the opened folding gripper 5, 6, and the resilient bodies 14 are just beginning to act on the section 3 to be torn off. The web of material from which the section 3 is to be torn off is held behind the perforation cut to be severed by holding rollers (not shown), or a cylinder pair (not shown) applying the perforation cuts.

Figure 2:
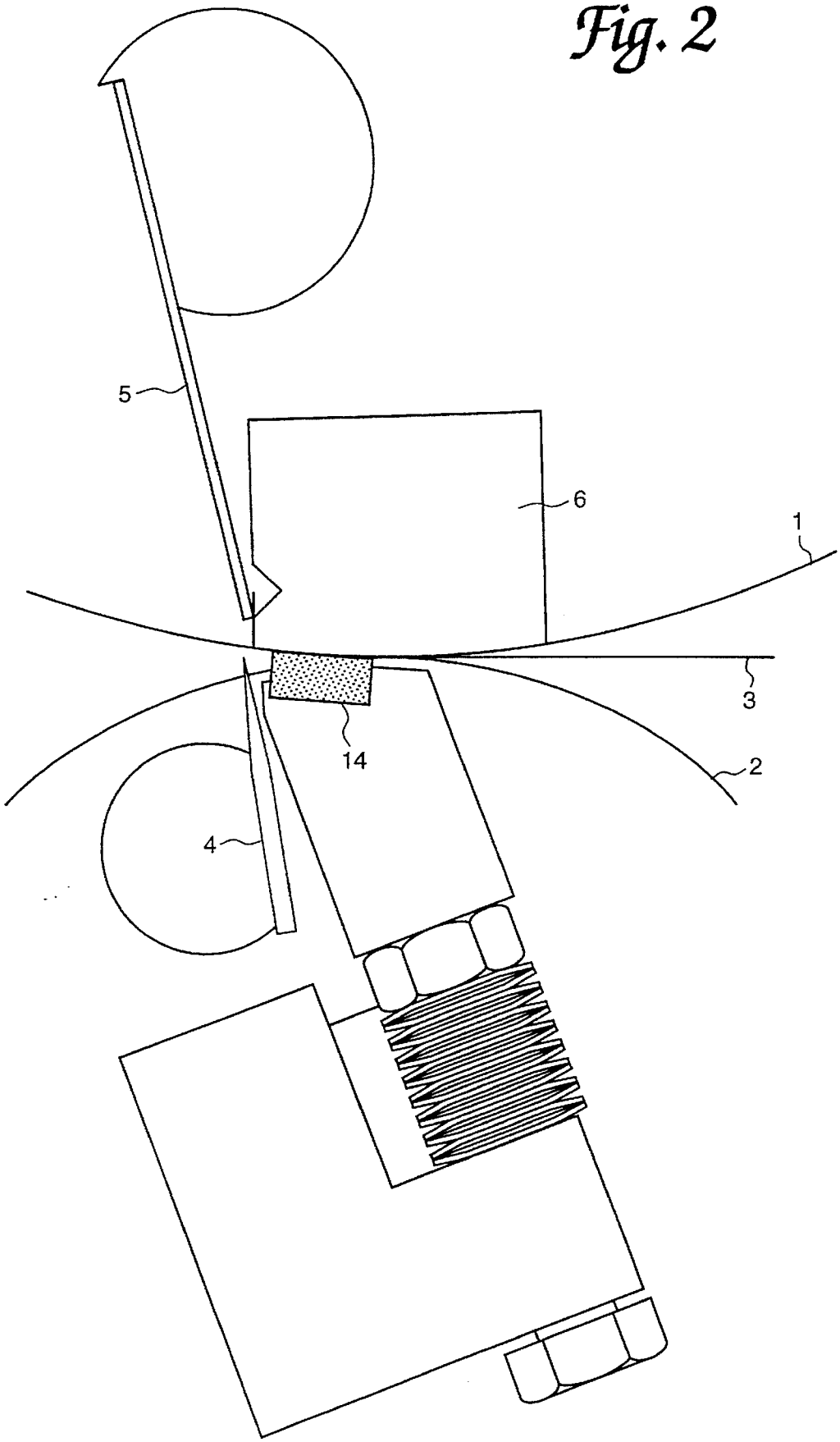
FIG. 2 shows the tearing-off roller pair of FIG. 1, at the time when the resilient bodies are still situated in the zone of their common line of contact.

FIG. 2 shows the state when the folding gripper 5, 6 has closed and is holding, with a clamping grip, the front end of the section 3 to be torn off and the resilient bodies have been rotated further from their position where they act at an acute angle on the section 3 as in FIG. 1, into a position wherein they are pressing on the section 3 over its whole area.

Figure 3:
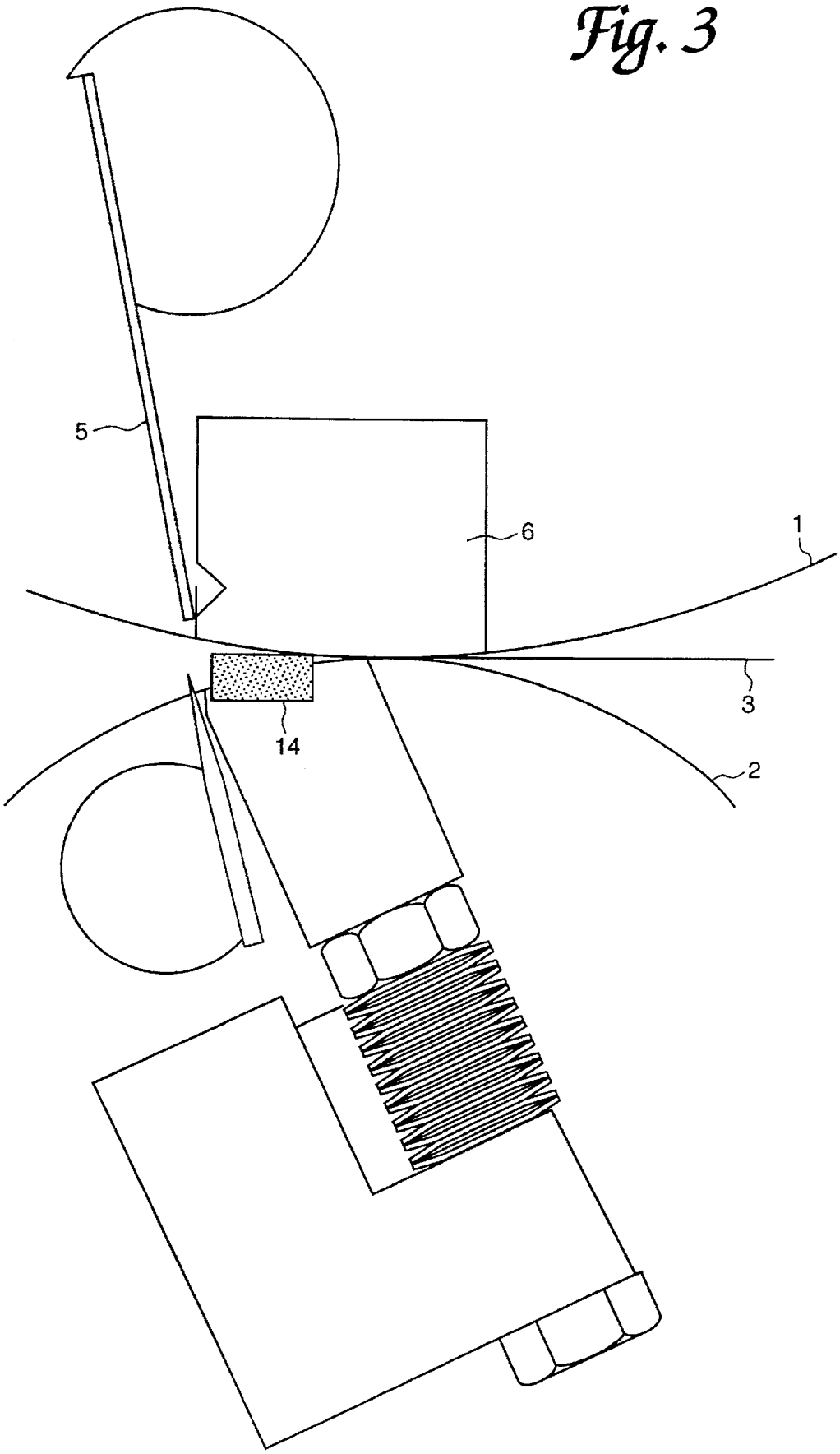
FIG. 3 shows the tearing-off roller pair of FIG. 1, at a time when the resilient bodies have passed their common line of contact.

FIG. 3 shows a position of the rollers 1, 2 when the resilient bodies 14 are again detached from the section 3 that has now been torn off, so that the latter is conveyed further by the gripper 5, 6.

Figure 4:
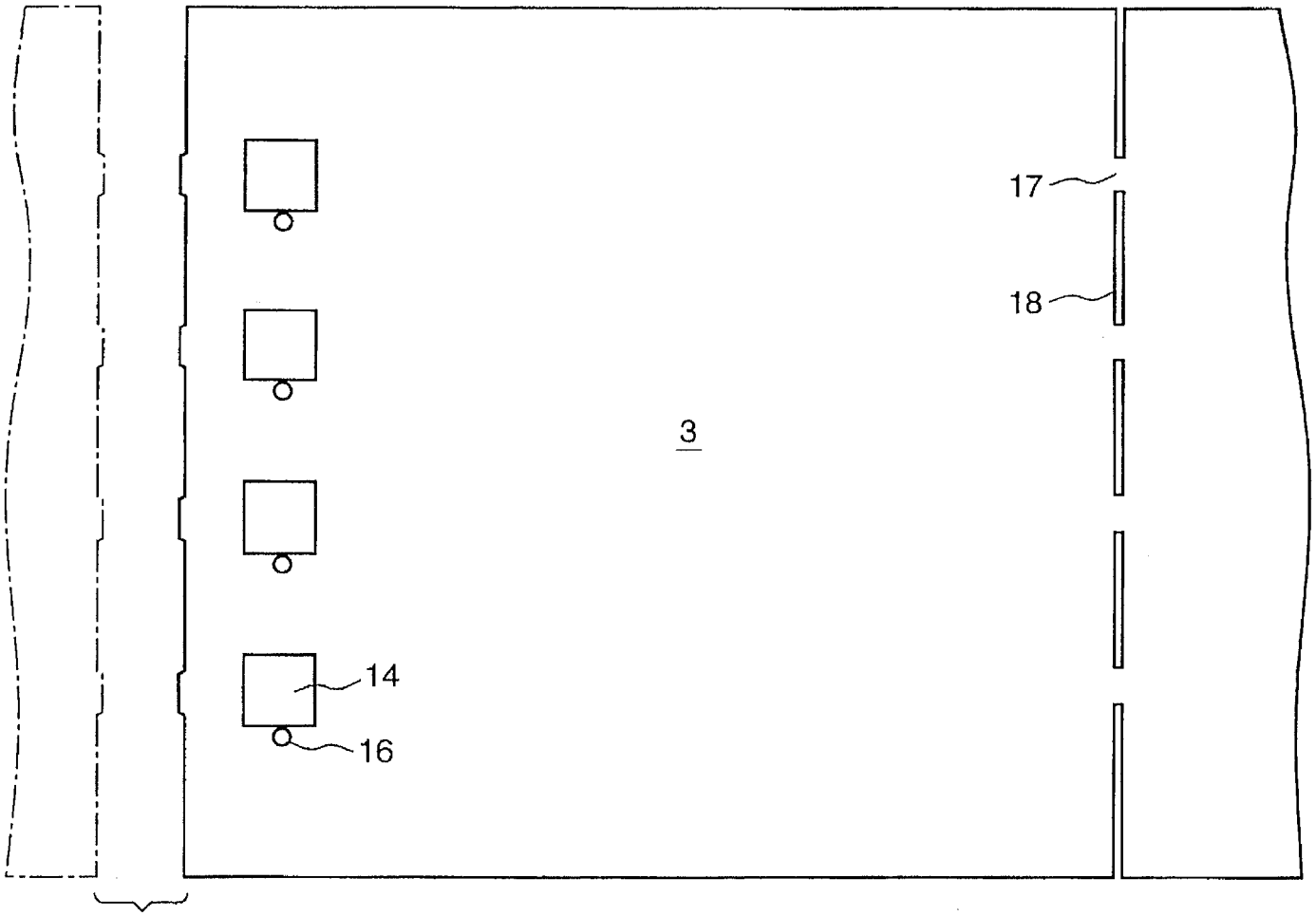
FIG. 4 is a top view of the row of the resilient bodies projected onto the material web.

FIG. 4 shows a schematic top view of the resilient bodies 14 clamping the section 3. The resilient bodies 14 are square in cross-section. For aligning them in their correct position in the recess 13, the groove includes centering pins 16 whereon the resilient bodies 14 bear.

FIG. 4 shows moreover that the resilient bodies 14 are aligned with the trailing lands 17 of the perforation cuts 18, so that the tearing off tensions are introduced into the lands 17 to be severed, over the shortest distance.

Figure 5:
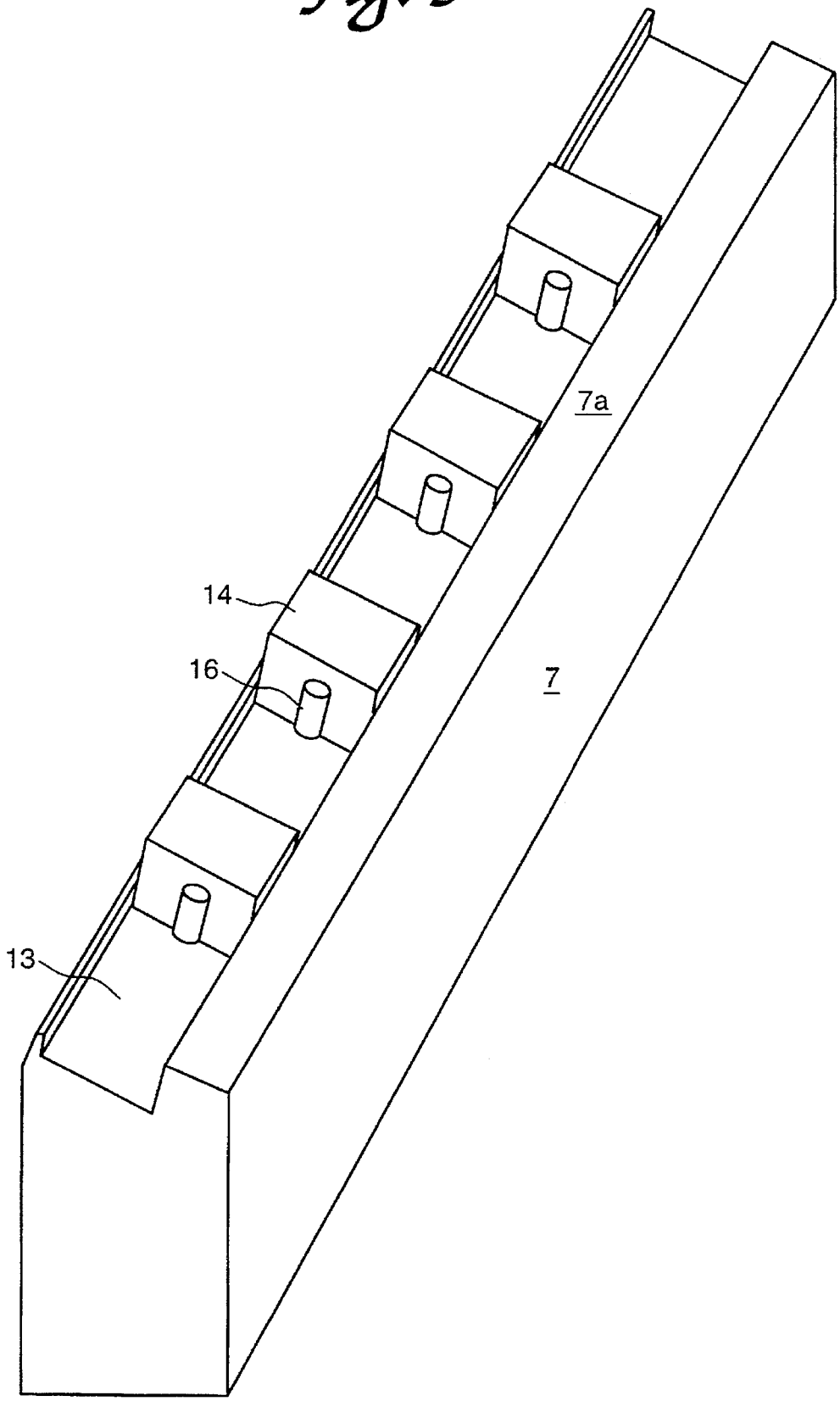
FIG. 5 is a perspective view of the resilient bodies mounted in a groove of the pressure bar.

FIG. 5 shows a perspective view of the pressure bar 7 which is provided with a recess 13 in which the cuboid resilient bodies 14 are mounted. Moreover, FIG. 5 also shows the centering pins 16 fixed in the base of the recess 13 whereon the resilient bodies 14 bear for their alignment.

We claim:

1. A tearing-off roller pair for tearing off sections or strips divided by perforations from a material web, comprising a first roller with a substantially smooth steel shell and, applied against said first roller, a second roller with at least one resilient body means set into said second roller for increasing contact pressure between said first and second rollers, which body means in its unstressed state projects radially beyond a peripheral cylindrical surface of the second roller;

wherein said resilient body means comprises several interspaced resilient bodies set into a groove in the peripheral cylindrical surface of the second roller;

wherein said resilient body means is recessed into a bar and said bar is disposed against means for providing a spring force and said bar is arranged in said groove of the second roller and carries the resilient body means at its front face; and wherein said groove accommodating the bar is offset from a diametral plane of the second roller such that the bar extends parallel to and is offset from the diametral plane such that the bar lies substantially behind the diametral plane in a direction of rotation when the diametral plane intersects a line of contact with the first roller.

2. A tearing-off roller pair for tearing off sections or strips divided by perforations from a material web, comprising a first roller with a substantially smooth steel shell and, applied against said first roller, a second roller with at least one resilient body means set into said second roller for increasing contact pressure between said first and second rollers, which body means in its unstressed state projects radially beyond a peripheral cylindrical surface of the second roller;

wherein said resilient body means comprises several interspaced resilient bodies set into a groove in the peripheral cylindrical surface of the second roller;

wherein said resilient body means is recessed into a bar and said bar is disposed against means for providing a spring force and said bar is arranged in said groove of the second roller and carries the resilient body means at its front face; and wherein the resilient bodies each have a front edge and at least one substantially planar surface extending from the front edge, and are set into the bar at an angle such that with the front edge at a point of contact with the first roller, an acute angle is formed by the planar surface and a tangent drawn through said point of contact.

* * * * *